US006135790A

United States Patent [19]

Huang et al.

[11] Patent Number: 6,135,790

[45] Date of Patent: Oct. 24, 2000

[54] ELECTRICAL CONNECTOR

[75] Inventors: Nan-Tsung Huang; Kun-Tsan Wu, both of Tu-Chen, Taiwan

[73] Assignee: Hon Hai Precision Ind. Co., Ltd., Taipei Hsien, Taiwan

[21] Appl. No.: 09/370,085

[22] Filed: Aug. 6, 1999

[30] Foreign Application Priority Data

Jul. 22, 1999 [TW] Taiwan ..... 88112485

[51] Int. Cl.[7] ..... H01R 9/09

[52] U.S. Cl. ..... 439/79; 439/607

[58] Field of Search ..... 439/79, 607, 80

[56] References Cited

U.S. PATENT DOCUMENTS 5,725,386 3/1998 Davis et al. ..... 439/79

5,779,489 7/1998 Davis et al. ..... 439/79

*Primary Examiner*—Gary F. Paumen

*Attorney, Agent, or Firm*—Wei Te Chung

[57] ABSTRACT

An electrical connector comprises a dielectric housing, a plurality of contacts retained within the housing, a spacer mounted to the housing for properly separating and positioning the contacts, and a metallic shell enclosing the housing and the spacer therein. Each contact comprises a curved contact section, an elongate planar engaging section and a connecting tail. The housing comprises a base and a mating board outwardly extending from the base. The base defines a cavity in a rear surface thereof, a plurality of vertically aligned apertures in communication with the cavity for insertion of the contacts therethrough, and a plurality of vertically aligned slits in a side wall in communication with the corresponding apertures for engaging with the engaging sections of the corresponding contacts. A plurality of engaging slots are defied in the mating board in communication with the corresponding apertures of the base for receiving the contact sections of the contacts therein.

6 Claims, 8 Drawing Sheets

ELECTRICAL CONNECTOR

BACKGROUND OF THE INVENTION

The present invention relates to an electrical connector, and particularly to an electrical connector having contacts which are easily manufactured by a simple mold at low costs.

A conventional electrical connector is disclosed in Taiwan Patent Application No. 85218083 as shown in FIG. 1. The electrical connector comprises a dielectric housing 70 and a plurality of contacts 72 received in the housing 70. Each contact 72 comprises a contacting section 720, an engaging section 721 and a connecting tail 722. Each of the engaging sections 721 and each of the connecting tails 722 of the contacts 72 are different thereby making it difficult to form the contacts in a simple mold. A multiple mold is usually required to fabricate the contacts 72 thereby complicating manufacture of the contacts and increasing costs thereof.

Another conventional electrical connector is disclosed in Taiwan Patent Application No. 85217217 as shown in FIG. 2. The electrical connector comprises a dielectric housing 8, four contacts 9 received in the housing 8, and a metallic shell 80 enclosing the housing 8. The housing 8 defines four vertically aligned receiving passageways 82 for receiving the corresponding contacts 9 therein. The receiving passageways 82 are shaped differently thereby complicating the structure of a mold used for insert molding the housing 8. Each contact 9 has a contacting section 91, an engaging section 92 and a connecting tail 93. Four positioning slots 83 are defined in the housing 8 below the receiving passageways 82 for positioning the connecting tails 93 and separating the connecting tails 93 from the connecting tails 93 of the adjacent contacts 9.

The engaging sections 92 of the contacts 9 are bent and have different widths corresponding to the receiving passageways 82 of the housing 8. The connecting sections 93 of the contacts 9 have different lengths corresponding to the receiving passageways 82 of the housing 8. Thus, the contacts 9 are manufactured by different individual molds, or a multiple mold. If the contacts 9 are formed by different individual molds, the production rate of the electrical connector will be very low and manufacturing costs of the electrical connector will be greatly increased. If the contacts 9 are formed by a mold assembly, the multiple mold may be complicated and expensive thereby increasing manufacturing costs of the electrical connector.

Therefore, an improved contact as well as an improved manufacturing method the contact is required to increase production rates and to decrease costs thereof.

BRIEF SUMMARY OF THE INVENTION

A main object of the present invention is to provide an electrical connector having contacts which can be easily manufactured by a simple mold.

Another object of the present invention is to provide an electrical connector which properly separates and positions contacts retained therein thereby ensuring reliable signal transmission therethrough.

Another object of the present invention is to provide an improved method for manufacturing semi-finished contacts which can be easily formed into different finished-contacts thereby fulfilling different requirements.

An electrical connector in accordance with the present invention comprises a dielectric housing, a plurality of contacts retained within the housing, a spacer mounted to the housing for properly separating and positioning the contacts, and a metallic shell enclosing the housing and the spacer therein. Each contact comprises a curved contact section, an elongate planar engaging section and a connecting tail. The housing comprises a base and a mating board outwardly extending from the base. A cavity is defined in a rear surface of the housing. A plurality of vertically aligned apertures is defined in the base in communication with the cavity for insertion of the contacts therethrough. A plurality of vertically aligned slits is defined in a side wall in communication with the corresponding apertures for engaging with the engaging sections of the corresponding contacts. A plurality of engaging slots is defined in the mating board in communication with the corresponding apertures of the base for receiving the contact sections of the contacts therein. A plurality of positioning slots is defined in a lower edge of the base below the apertures for properly separating the connecting tails of the contacts. A planar projection outwardly extends from an inner surface of the spacer for engaging within the cavity of the housing. The spacer defines a plurality of vertical elongate positioning notches parallel to each other in an inner surface of the planar projection of the spacer for positioning the connecting tails of the corresponding contacts.

After the contacts are positioned in the housing, the connecting tails are horizontally aligned and separated by the corresponding positioning slots thereby ensuring reliable signal transmission therethrough. The spacer is then mounted to the rear surface of the base of the housing to position the connecting tails of the contacts. The shell thus receives the housing and spacer therein. A rear cover extending from a side wall of the shell is simultaneously properly bent to cover the spacer and latches with a latching tab formed on an opposite lateral side of the shell by a latching arm outwardly extending from the rear cover.

The contacts are Z-shaped and identical semi-finished contacts are formed by a simple mold. The electrical connector is manufactured following the steps described below. A first step is to insert mold the dielectric housing. In a second step, each semi-finished contact is formed by the same mold. In each semi-finished contact, four connecting tails having different lengths are aligned and connected to the elongate engaging section of the semi-finished contact. The engaging section and the connecting tails of the semi-finished contact lie in a same plane as a carrier strip to which the semi-finished contact is connected. The curved contact section is connected to the engaging section opposite the connecting tails. The second step includes properly bending the engaging section of the semi-finished contact into a "Z" shape while integrally rotating the contact section to be perpendicular. A third step is to insert the semi-finished contacts into the corresponding engaging slots via the apertures of the housing and properly severe non-required connecting tails away from each semi-finished contact as well as simultaneously bending the required connecting tails to fit into the corresponding positioning slot of the housing. The last step is to complete assembly of the electrical connector by fixing the spacer and the shell with the housing.

Other objects, advantages and novel features of the invention will become more apparent from the following detailed description when taken in conjunction with the accompanying drawings.

DETAILED DESCRIPTION OF THE INVENTION

Figure 1:
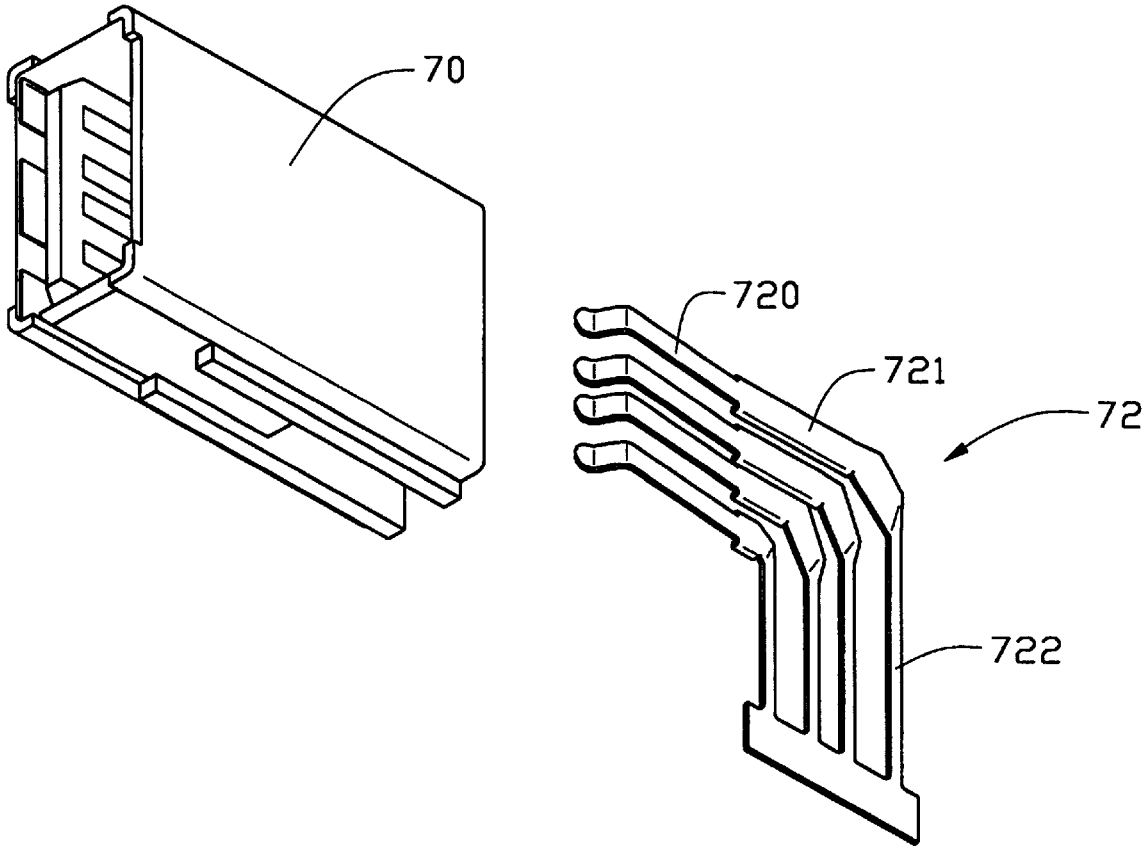
FIG. 1 (PRIOR ART)
FIG. 1 is an exploded view of a conventional connector.
Figure 2:
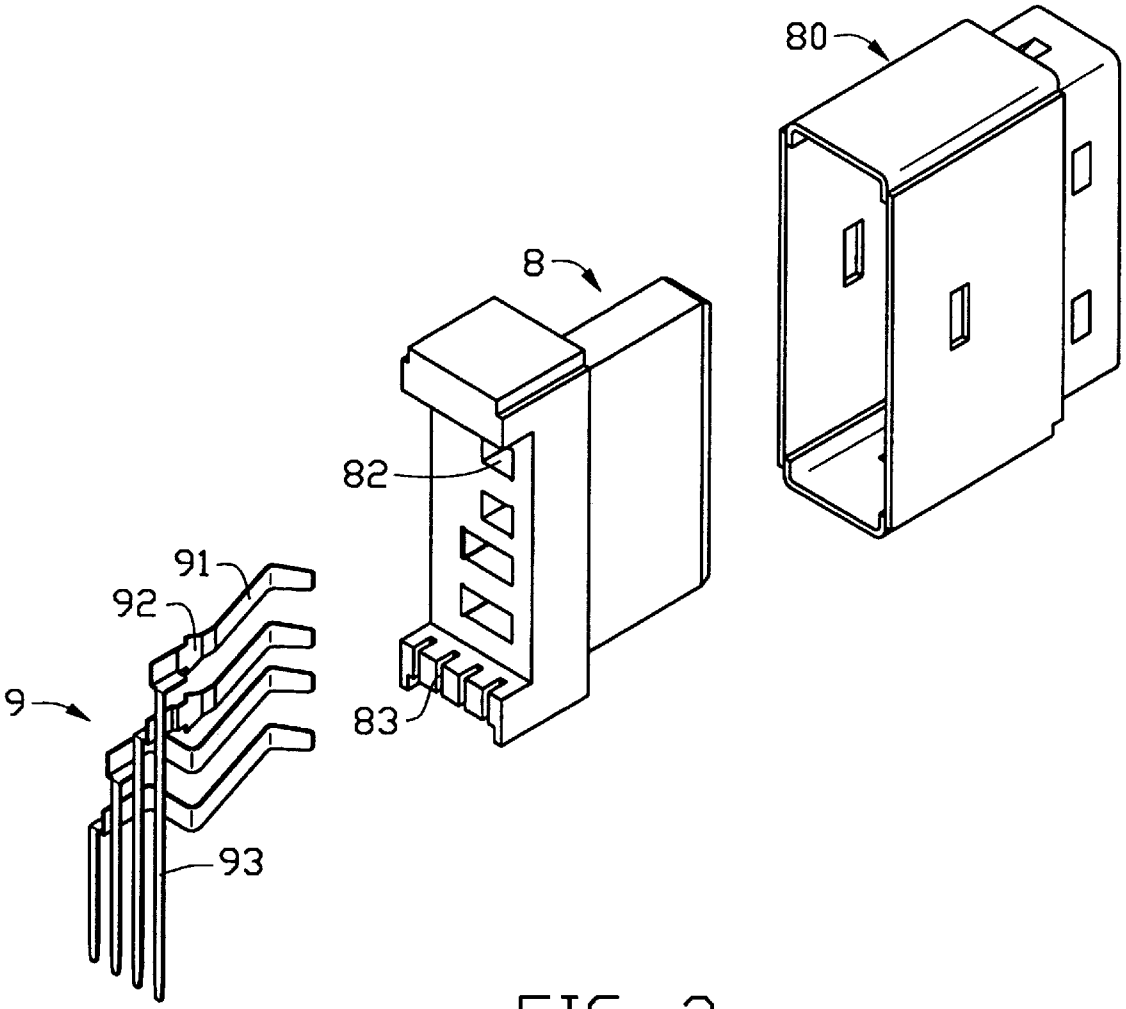
FIG. 2 (PRIOR ART)
FIG. 2 is an exploded view of another conventional connector.
Figure 3:
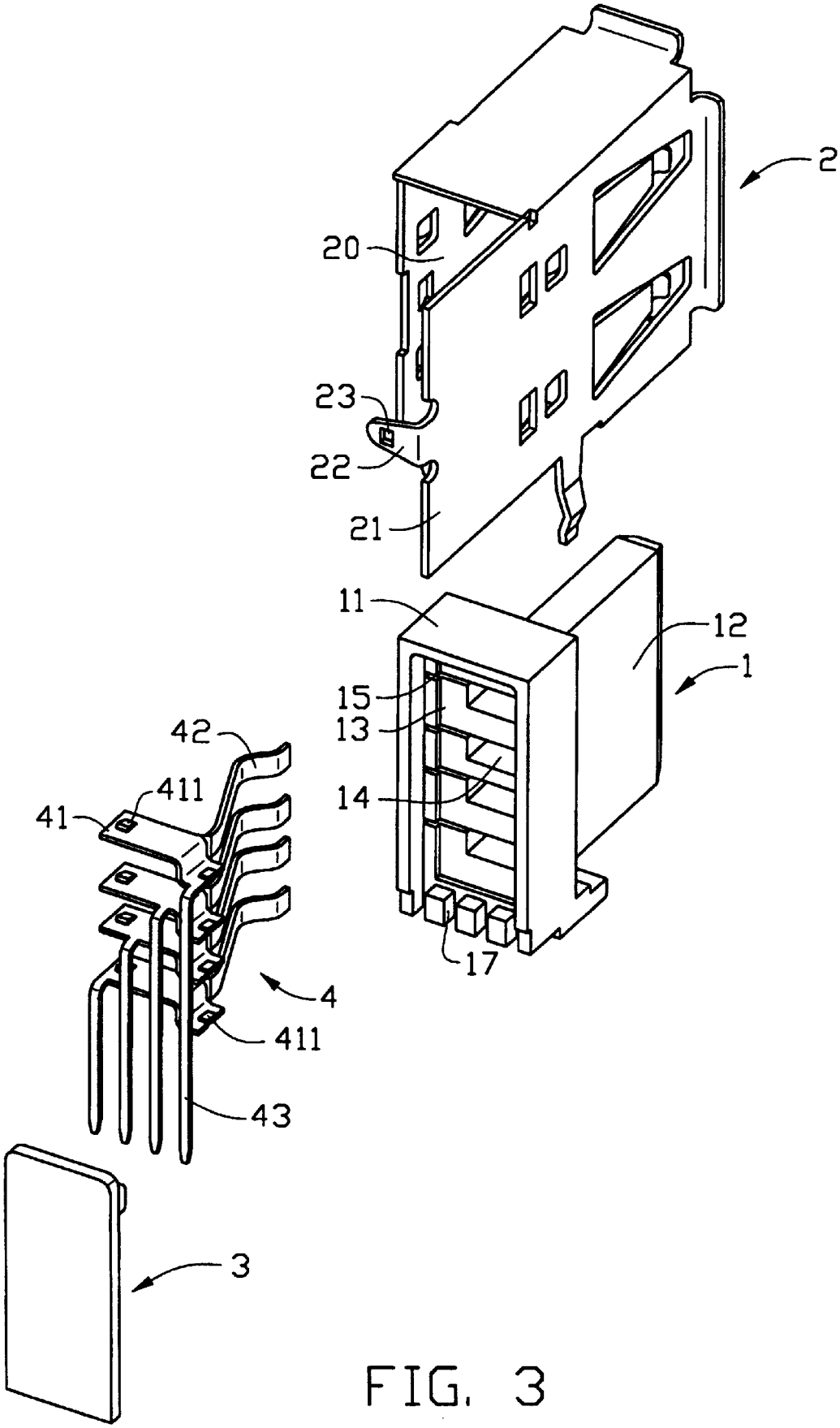
FIG. 3 is an exploded view of an electrical connector in accordance with the present invention.
Figure 4:
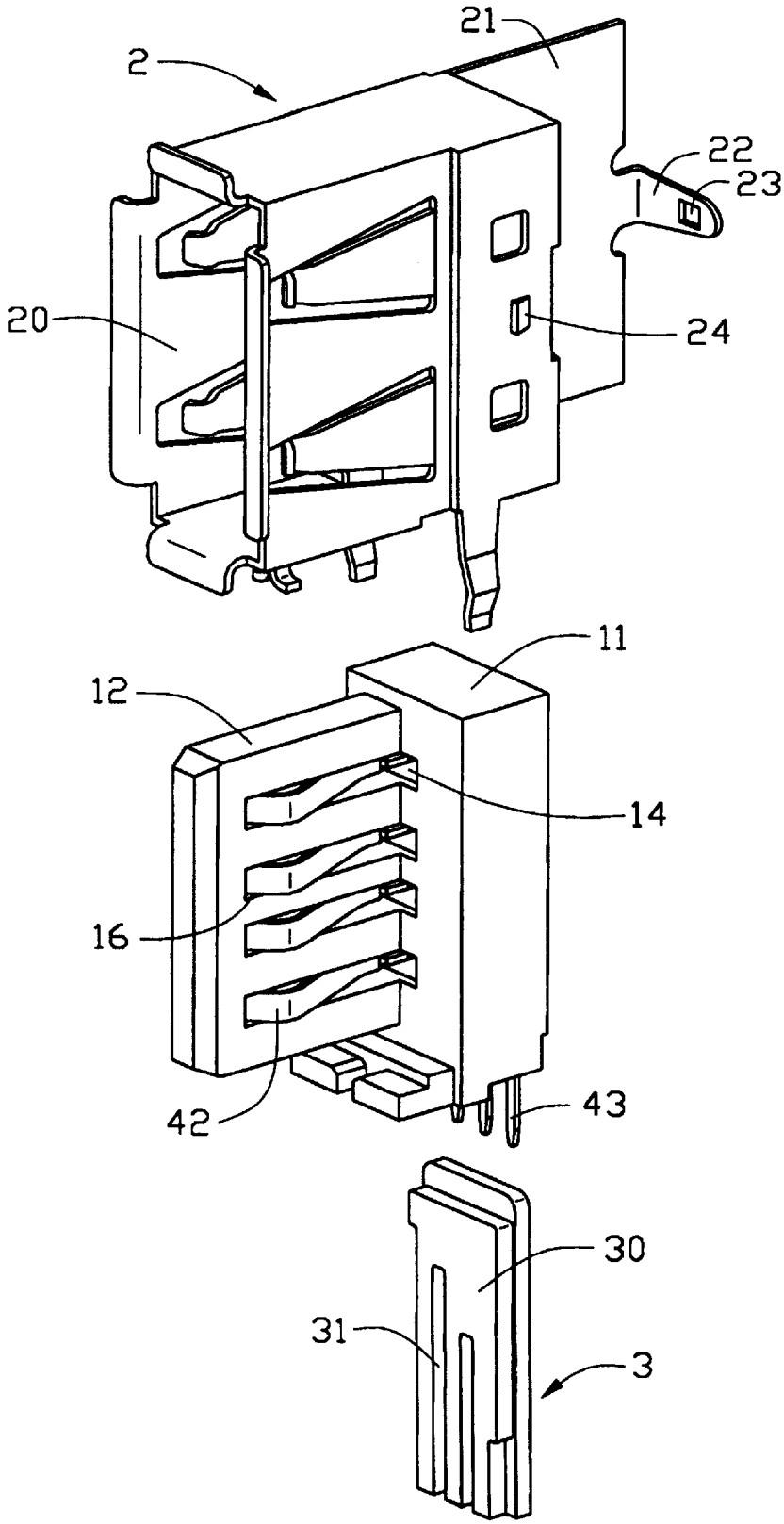
FIG. 4 is an exploded view of the connector with contacts thereof assembled with a housing of the connector.
Figure 5:
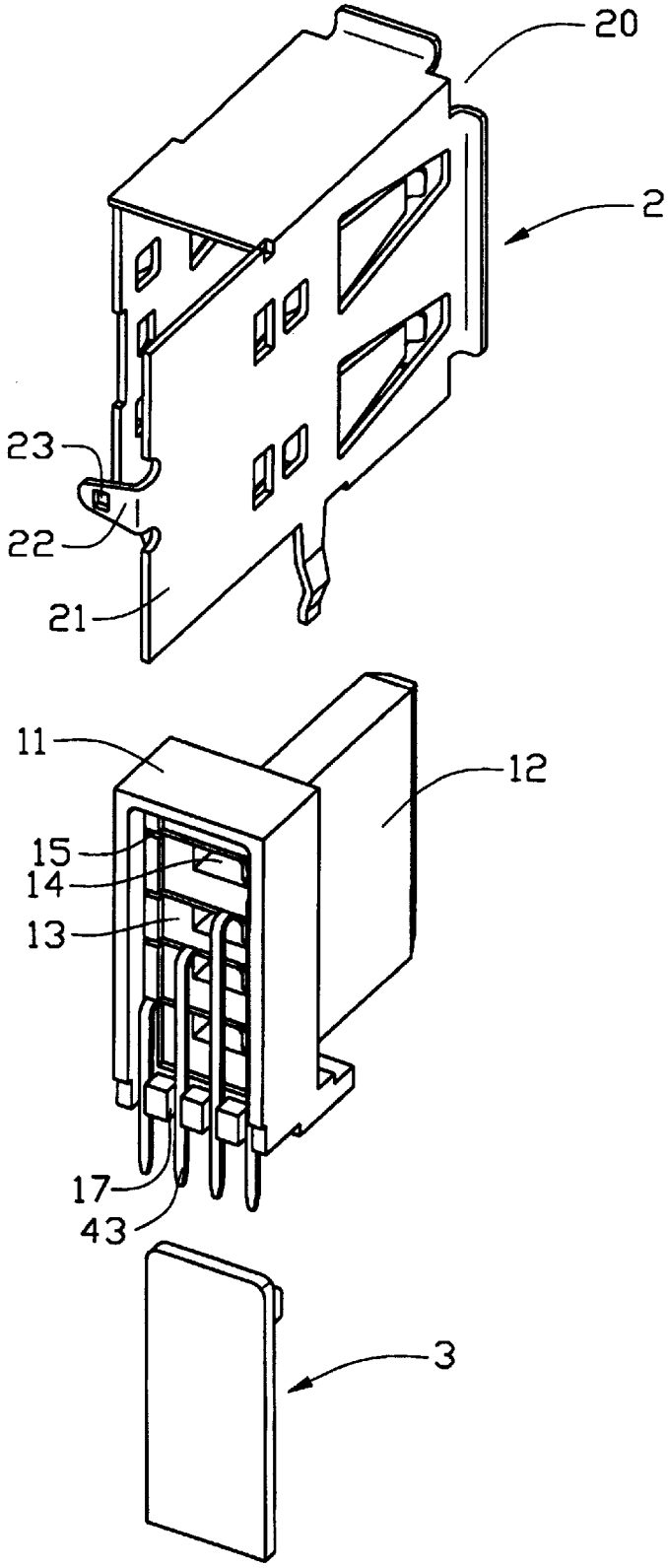
FIG. 5 is similar to FIG. 4 taken from a different perspective.

Referring to FIGS. 3, 4 and 5, an electrical connector in accordance with the present invention comprises a dielectric housing 1, a plurality of contacts 4 retained within the housing 1, a spacer 3 mounted to the housing 1 for positioning the contacts 4, and a metallic shell 2 enclosing the housing 1 and the spacer 3 therein.

The housing 1 comprises a base 11 and a mating board 12 outwardly extending from the base 11. An elongate cavity 13 is defined in a rear surface of the housing 1. A plurality of vertically aligned apertures 14 is defined in the base 11 in communication with the cavity 13 for insertion of the contacts 4 therethrough. A plurality of vertically aligned slits 15 is defined in a side wall of the base 11 in communication with the corresponding apertures 14 for engaging with engaging sections 41 (to be described in detail later) of the corresponding contacts 4. A plurality of engaging slots 16 is defined in the mating board 12 in communication with the corresponding apertures 14 of the base 11 for receiving contacting sections 42 (to be described later) of the contacts 4 therein. A plurality of positioning slots 17 is defined in a lower edge of the base 11 below the apertures 14 and in communication with the cavity 13 for properly separating corresponding connecting tails 43 (to be described later) of the contacts 4.

A planar projection 30 outwardly extends from an inner surface of the spacer 3 for engaging within the cavity 13 of the housing 1. The spacer 3 defines a plurality of vertical elongate positioning notches 31 parallel to each other in an inner surface of the planar projection 30 of the spacer 3 for properly positioning the connecting tails 43 of the corresponding contacts 4.

Each contact 4 comprises the horizontal engaging section 41 for securely engaging with the corresponding slit 15 of the housing 1, the curved contact section 42 forwardly extending from the vertical section 44, which extends downwardly adjacent one end of the horizontal engaging section 41, for engaging with a mating connector, and the connecting tail 43 downwardly extending from the engaging section 41 for connecting to a circuit board (not shown). The engaging section 41 of each contact 4 is elongate and planar, and is bent to have a "Z" shape in compliance with the configuration of the corresponding slit 15 and the corresponding aperture 14. A pair of engaging tabs 411 is formed on an upper face of the engaging section 41 at opposite ends thereof for abutting against inner surfaces of the corresponding slit 15 and the apertures 14, respectively. The connecting tails 43 of the contacts 4 have different lengths and extend from different corresponding engaging sections 41.

The shell 2 is stamped and formed from a metal material for enclosing the housing 1, the contacts 4 and the spacer 3 therein. The shell 2 defines a receiving chamber 20 for receiving the housing 1 therein. A rear cover 21 outwardly extends from a side wall of the shell 2 for being properly bent to cover the spacer 3. A latching arm 22 perpendicularly extends from the rear cover 21 and defines a latching hole 23 therein for engaging with a latching tab 24. The latching tab 24 is outwardly formed on another side wall opposite the rear cover 21.

Figure 6:
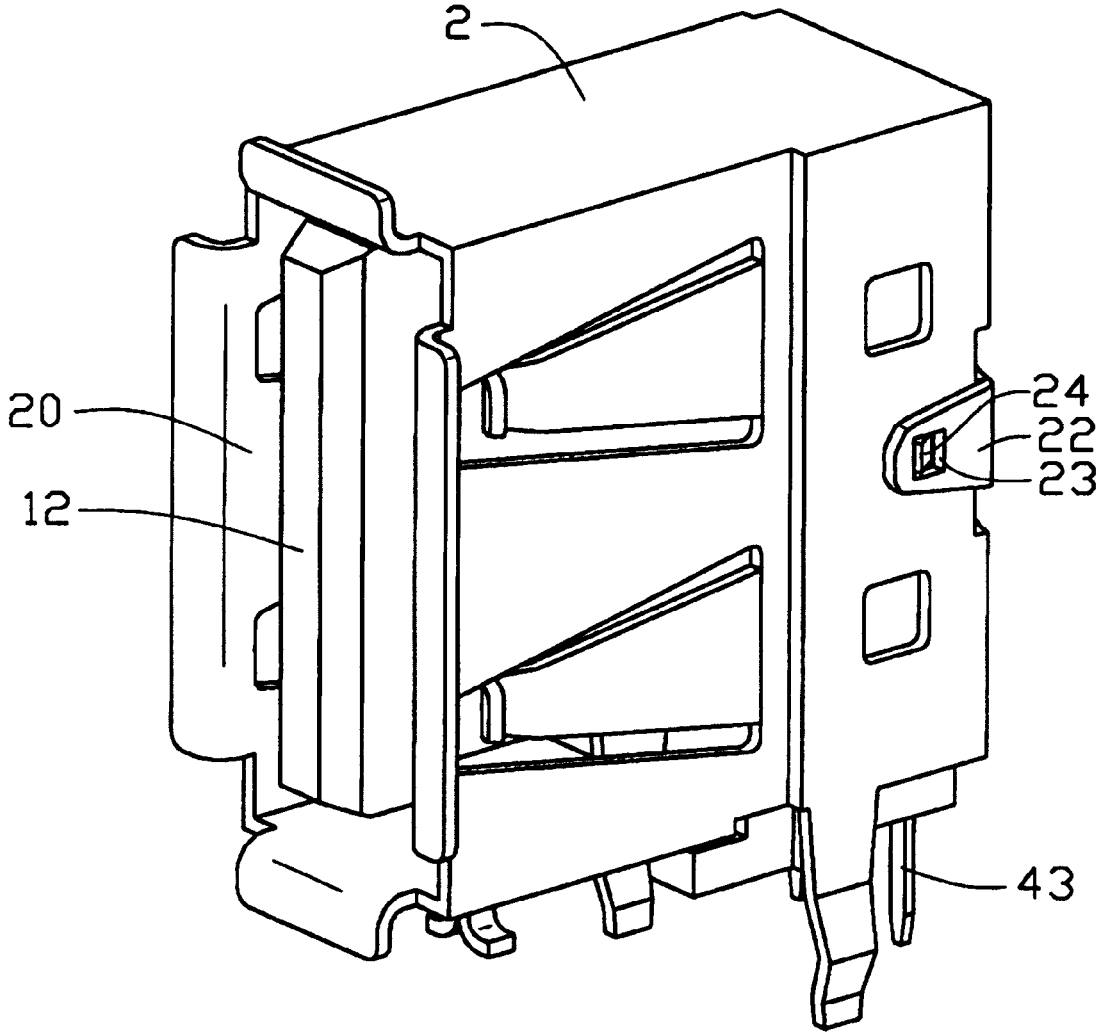
FIG. 6 is an assembled view of FIG. 3.

Referring also to FIG. 6, after assembly, the contacts 4 are received in the housing 1. The contact sections 42 of the contacts 4 are positioned within the corresponding receiving slots 16 of the mating board 12 of the housing 1, while the engaging sections 41 engage within the corresponding slits 15 and the apertures 14. The connecting tails 43 of the contacts 4 downwardly extend through the corresponding positioning slots 17 of the housing 1 and are parallel to each other. The planar projection 30 of the spacer 3 engages within the cavity 13 of the housing 1, while the notches 31 engage with the connecting tails 43 of the corresponding contacts 4 for retaining the connecting tails 43 in position thereby preventing the connecting tails 43 of the contacts 4 from deflection resulting in improper electrical contacts. The housing 1, the contacts 4 and the spacer 3 are received in the receiving chamber 20 of the shell 2. The rear cover 21 is properly bent to cover the spacer 3 to prevent rearward movement of the spacer 3 and the housing 1. The latching hole 23 of the latching arm 22 engages with the latching tab 24.

Figure 7:
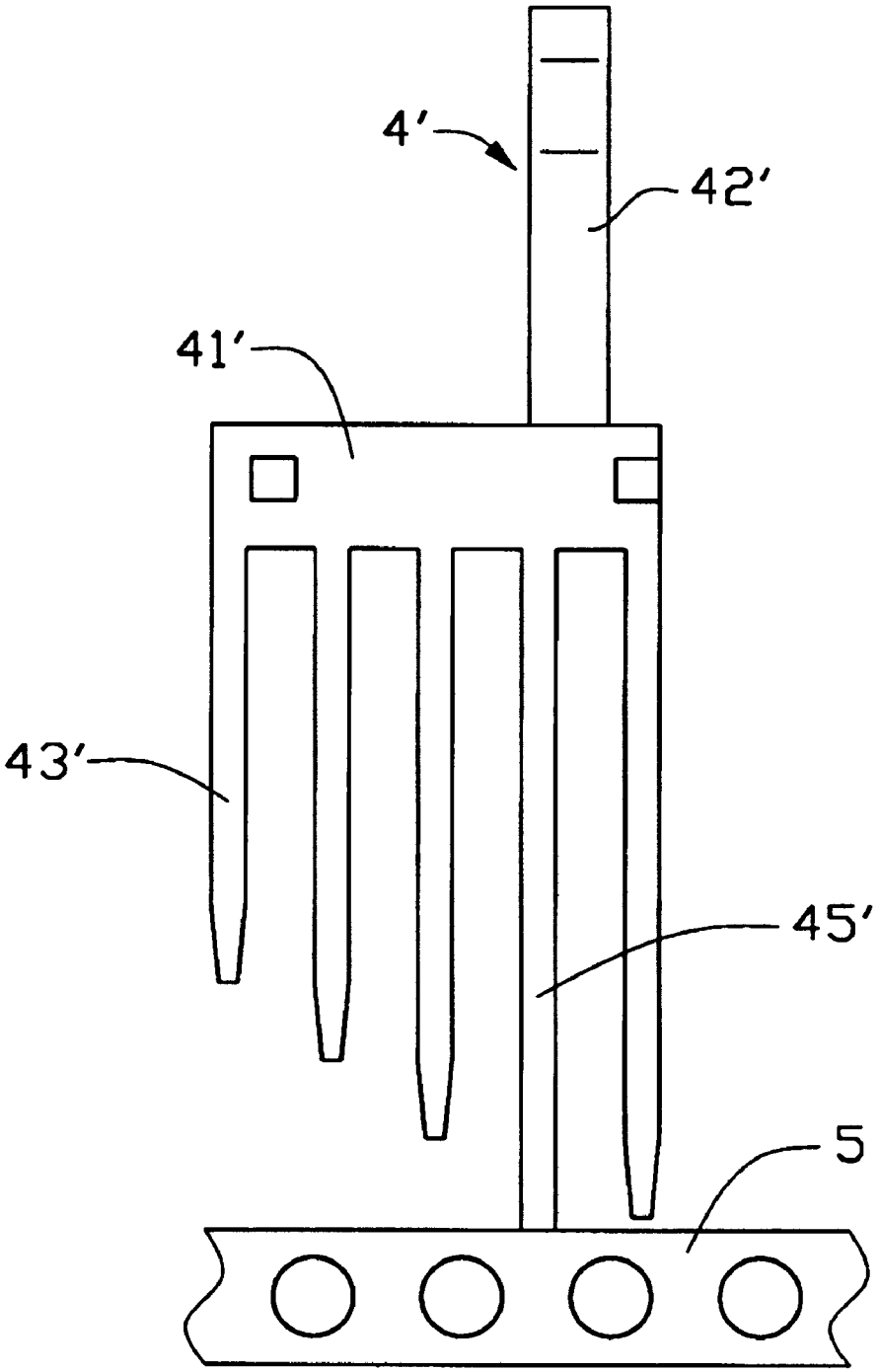
FIG. 7 is a top plan view of a semi-finished contact of the present invention connected with a carrier strip before the semi-finished contact is bent.
Figure 8:
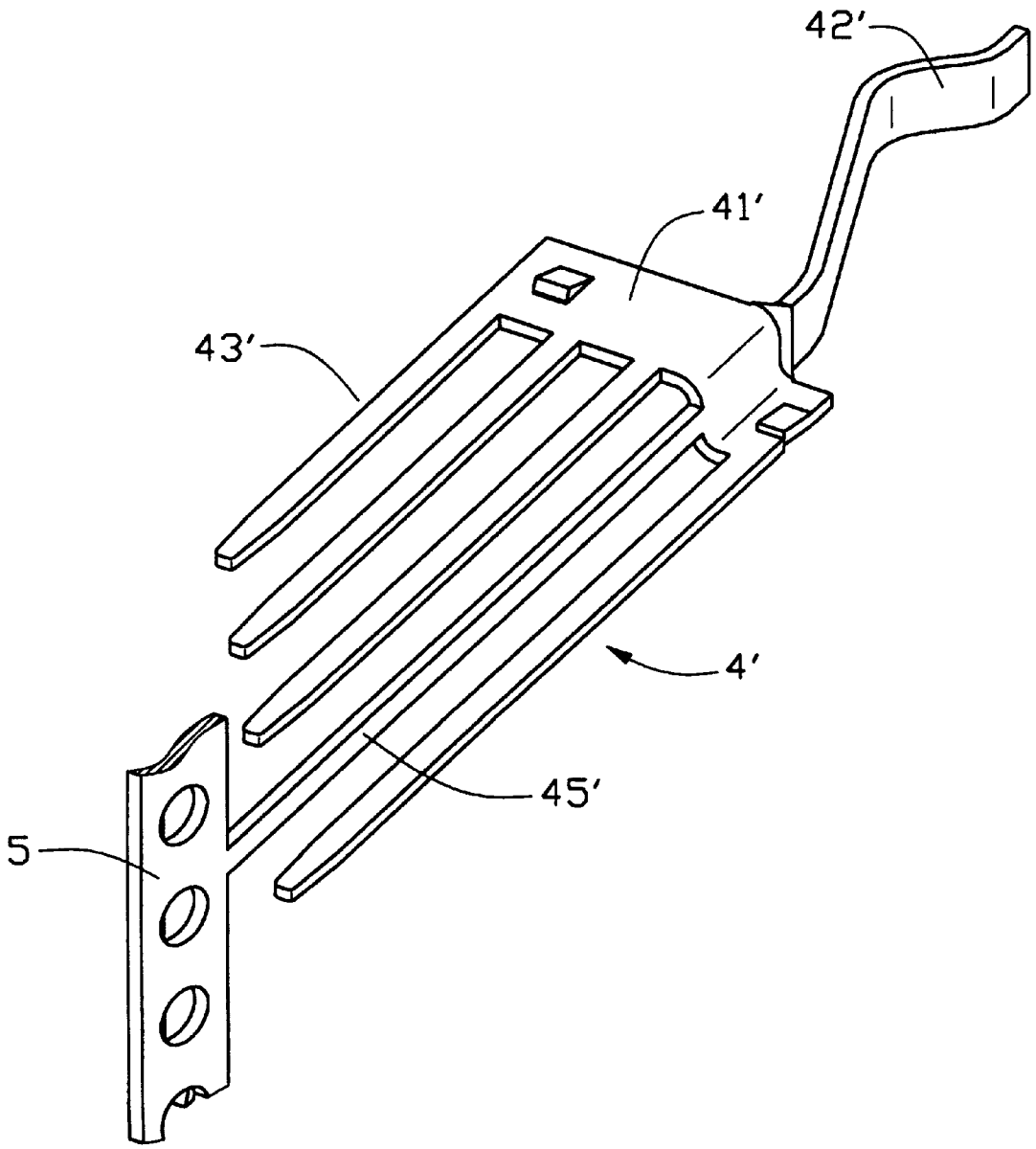
FIG. 8 is a perspective view of the semi-finished contact and the carrier strip of FIG. 7 after the semi-finished contact is bent.

Referring further to FIGS. 7 and 8, each contact 4 corresponds to a semi-finished contact 4' when the contact 4 is formed by a single mold (not shown). The electrical connector of the present invention is manufactured following the steps described below. A first step is to fabricate the dielectric housing 1, the spacer 3 and the shell 2.

In a second step, each semi-finished contact 4' is formed by the same mold. In each semi-finished contact 4', four connecting tails 43' having different lengths are aligned with each other and connect to an elongate planar engaging section 41'. The engaging section 41' and the connecting tails 43' of the semi-finished contact 4' lie in the same plane as a carrier strip 5 to which the semi-finished contact 4' is connected via a connecting leg 45'. A curved contact section 42' is connected to the engaging section 41' opposite the connecting tails 43'. The engaging section 41' of the semi-finished contact 4' is properly bent to form a "Z" shape while integrally rotating the contact section 42 to be perpendicular.

A third step includes inserting the semi-finished contacts 4' into the corresponding engaging slots 16 of the mating board 12 via the apertures 14 of the housing 1, and properly severing non-required portions of the connecting tails 43' and the connecting leg 45' away from each semi-finished contact 4' as well as simultaneously bending the required portions of the connecting tail 43' to fit into the corresponding positioning slot 17 of the housing 1. The last step is to complete assembly of the electrical connector by fixing the spacer 3 and the shell 2 with the housing 1.

It can be noted that because the curved contact sections 42 of the four contacts 4 are configured to be same with one another, the mechanical and electrical performance can be controllably practiced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising an elongate base and a mating board perpendicularly extending from a front surface of the base, the base defining an elongate cavity in a rear surface thereof and a plurality of apertures being longitudinally aligned along the elongate cavity and being in communication with the cavity, a plurality of engaging slots being defined in the mating board in communication with corresponding ones of the apertures, a plurality of longitudinally aligned slits being defined in a side wall between the front and rear surfaces and being in communication with corresponding ones of the apertures; and a plurality of contacts received in the housing, each contact comprising a Z-shaped elongate engaging section for engaging with corresponding slit and corresponding aperture of the base, a curved contact section outwardly extending from the engaging section, and a connecting tail downwardly extending from the engaging section and extending along the elongate cavity of the base, a pair of engaging tabs being formed on an upper face at opposite ends of the engaging section for respectively engaging with inner surfaces of the corresponding slit;

wherein each engaging section forms a pair of horizontal wings and a vertical wall therebetween; and the curved contact section integrally extends from a lateral edge of the vertical wall; and wherein the vertical walls of all of the contacts are located in a same first plane and the curved contact sections of all of the contacts are configured to be vertically aligned with one another.

2. The electrical connector as claimed in claim 1, further comprising a spacer forming a planar projection for communicating with the cavity of the hosing.

3. The electrical connector as claimed in claim 2, wherein a plurality of notches is defined in the planar projection for properly positioning and separating the connecting tails of corresponding contacts, thereby preventing the connecting tails from deflection resulting in improper electrical contact.

4. The electrical connector as claimed in claim 2, further comprising a metallic shell defining a receiving chamber for enclosing the housing and the spacer.

5. The electrical connector as claimed in claim 4, wherein a rear cover integrally extends from a side wall of the shell for being properly attached to cover the spacer.

6. The electrical connector as claimed in claim 5, wherein a latching arm perpendicularly extends from the rear cover and defines a latching hole therein for engaging with a latching tab formed on another side wall of the metallic shell opposite the rear cover.

* * * * *